United States Patent [19]

Schwartz

[11] Patent Number: 5,058,333

[45] Date of Patent: Oct. 22, 1991

[54] FOAM PANEL ROOF MOUNTING SYSTEM

[75] Inventor: Seymour L. Schwartz, Redondo Beach, Calif.

[73] Assignee: Airflo Aluminum Awning Company, Gardena, Calif.

[21] Appl. No.: 503,428

[22] Filed: Apr. 2, 1990

[51] Int. Cl.[5] ..... E04D 13/08

[52] U.S. Cl. ..... 52/73; 52/74; 52/90; 52/16; 52/729; 52/586

[58] Field of Search ..... 52/586, 309.11, 309.9, 52/729, 738, 777, 778, 779, 465, 90, 6, 463, 73

[56] References Cited

U.S. PATENT DOCUMENTS

| | | | |
|---|---|---|---|
| 2,828,235 | 3/1958 | Holland et al. | 52/604 |
| 2,957,483 | 10/1960 | Dunn | 52/74 |
| 3,100,012 | 8/1963 | Dunn | 52/90 |
| 3,359,022 | 12/1967 | Russell | 52/586 |
| 4,100,703 | 7/1978 | Sickler | 52/16 |

FOREIGN PATENT DOCUMENTS

| | | | |
|---|---|---|---|
| 47557 | 7/1974 | Australia | 52/586 |
| 1485237 | 1/1967 | France . | |

*Primary Examiner*—Richard E. Chilcot, Jr.
*Assistant Examiner*—Joanne C. Downs
*Attorney, Agent, or Firm*—David O'Reilly

[57] ABSTRACT

A foam roofing system in which a unique universal beam allows adjacent foam roofing sections to be joined and substantially eliminates water leaks. The universal beam is formed with a design that creates a series of water dispersing channels on either side of a center web and a third concave channel on a surface opposite the channels. Adjacent roofing panels are joined by two of the universal beams on upper and lower surfaces with the beams being in reverse orientation. The beam thus provides a series of at least three separate channels for dissipating excess water. The system also includes a unique coupling splice for joining joists, or cross beams, that support the roofing system. The splice coupling has stiffening ribs to prevent collapse of hollow sheet metal joists when bolted together. The universal beam also accommodates transparent panels to allow the roofing system to include a skylight, if desired.

17 Claims, 4 Drawing Sheets

FOAM PANEL ROOF MOUNTING SYSTEM

FIELD OF THE INVENTION

This invention relates to roof system for patios and the like comprised of a plurality of abutting foam roof panels and more particularly relates to a universal beam for joining adjacent panels.

BACKGROUND OF THE INVENTION

Foam roof panels are now widely used in patio covers, small buildings and the like and are formed into roofs with interlocking beams. The beams form a channel for receiving adjacent abutting edges of the foam panels. Several panels joined together form a sturdy, durable roof. More or less panels are used depending upon the size of the roof desired.

Of course it is imperative that the foam panels be securely joined and also form a water tight seal. Water leaks are a frequent problem with present methods of joining these panels. The beams are supposed to form a watertight seal, but often long use and particularly when waterfall is heavy, seepage around and between adjacent joint edges is a problem. To combat this problem, some coupling beams are formed with a water dispersing channel. While this helps, in many cases it is inadequate because the channel quickly fills and the roof begins to leak.

These foam roofs are often used as patio covers. For this use, a lengthwise beam is used to join one edge of the roof to a wall. A metal abutment called flashing is used along the top edge of the roof where it joins the wall to prevent water leaks. The flashing must be sealed with some type of sealant such as caulking. The proper installation of the flashing is an expensive labor intensive task that does not always provide as good a watertight seal as one would like. Unless extreme care is taken at the time of installation, leaks can develop. Water, while not known as a particularly effective solvent, is a corrosive, destructive material and watertight seals are, for that reason, important.

It is one object of the present invention to provide a unique joining beam for abutting foam roof panels, which substantially eliminates water leaks.

Yet another object of the present invention is to provide a joining beam having a design that forms a plurality of water dispersing channels to substantially eliminate leaks.

Still another object of the present invention is to provide a universal joining beam support joining abutting panels which is easy to install and use.

Still another object of the present invention is to provide a wall mounting ledger system for roof system that provides an efficient watertight seal.

Still another object of the present invention is to provide a ledger system for foam roof panels to provide a wall mounting that is simple and easy to install.

Yet another object of the present invention is to provide a ledger system for mounting home roof panels to a wall providing a pivoting, pinless hinge system for easy installation of the foam roof panels.

Yet another object of the present invention is to provide a beam support system including a unique splice or coupling to lengthen support beams for foam roof panels.

Still another object of the present invention is to provide a beam or support system for foam roof panels including an insert having length-wise parallel flanges for reinforcing the beams when bolted together.

Yet another object of the present invention is to provide a foam roof panel system including an integrally formed skylight.

Still another object of the present invention is to provide a unique foam roof panel system incorporating a skylight with the unique leak preventing joining beam.

BRIEF DESCRIPTION OF THE INVENTION

The purpose of the present invention is to provide a unique foam panel system having leak-proof joining beams for adjacent foam panels, a unique ledger system securing the foam panel roof to a wall that provides a watertight seal, a unique beam splicing system that provides an insert for joining adjacent beam lengths for extending roof systems, and a skylight system for incorporation into the foam roof.

Foam roof panels are constructed of synthetic foam panels usually two feet by ten to twenty feet long joined by coupling systems to form a free-standing or wall mounted roof. The wall mounted roof can be used for patio covers and/or room extensions, or the like. Each foam panel is usually covered with a durable layer of plastic, or sheet metal material. Adjacent panels are joined by an abutting beam having channels for receiving each adjacent foam panel section of the roof. The foam panels are formed with a sculptured edge for insertion in the channels of the universal coupling beam. The beam has a t-shaped portion having flanges formed on the bottom of the T providing lengthwise channels to disperse water that may seep around the edges of the beam. The flanges forming the channels also form a concave curved surface on the opposite side of the lengthwise channels. When two beams, one reversed from the other, are used to join adjacent abutting panels, the lengthwise concave channel acts as an additional water dispersing channel for any water that might seep or leak around the main water dispersing channels of the beam above. Should any water leak around the main water dispersing channels, the concave curvature of the lower beam provides a trough which will disperse any water overflow from the main channel. The universal coupling beam at the top of the roof panels provides adjacent channels on either side of the center web for dispersing water with the same shaped universal beam reversed and mounted along the bottom edge of adjacent abutting panels forming a water dispersing trough. Thus, the two beams joining the upper and lower surfaces of adjacent abutting foam roof panels provide a series of multiple water dispersing channels to substantially prevent any possible leak of water seeping around the edge of the beam.

The foam roof panels, when joined, can be used to provide a free standing roof for a carport, but more often are used as roofing for room extensions, or patio covers. When used in the latter manner, the roof system is attached to a wall by a ledger system that provides a watertight seal. The ledger system is comprised of four pieces. A support plate attaches to the wall with lag bolts and has ribbed flanges for receiving sockets on pieces mounted to the foam panel roof. The mounting sockets are provided on a plate having a channel flange along one edge for the top of the roof panel and an L-shaped beam having a channel flange mounted along the lower edge of the roof panels. The junction of the L-shaped beam includes a C-shaped socket formed by flanges along the length of the beam. A flexible skirt inserted in this socket provides an additional seal for the roof mounting system against the wall.

In some cases, the length of the roof system may exceed the standard length of the beams. In this case, adjacent beams must be joined by an appropriate splicing system. For this purpose, a unique splicing insert is provided in the form of an elongate plate having parallel flanges forming a channel for bolts on either side of the splice. These elongate flanges prevent adjacent beams from collapsing when a force is applied to the joining bolts. Ribs formed on the inside of the hollow extruded aluminum beams provide guides for the splice insertion.

The beam for joining adjacent panels of the roof system is similar to an I-beam having a flat, lengthwise planar flange along one side of the central web and uniquely shaped flanges on the other side of the center web that forms three separate channels for water distribution. The flanges are constructed to provide water run-off channels on opposite sides of the center web. These flanges have a concave curvature to provide a channel or trough when the beam is reversed. Thus, the beam can be used to join upper and lower surfaces of adjacent roof panels and provide three run-off channels. Should water seep around the main channels provided by the flanges on either side of the center web in the upper beam, it will collect in a third channel provided by the lower reversed beam and its concave surface.

In addition to the unique coupling system providing support for adjacent roof panels, it also will provide support for a skylight, if desired. The beams have lengthwise outward extending flanges in the form of wing like appendages, having a surface parallel with the planar flange on the beam. The planar surface on these flanges and the planar flange on the web form a space or slot for receiving the contoured edge of roof panels, but are also dimensioned to receive a transparent panel made of a plastic material such as Lexan. Lexan panels inserted in the space between the flanges of beams on upper and lower surfaces can form a skylight in the roofing system.

The above and other features of this invention will be more fully understood from the following detailed description and the accompanying drawings, in which:

DETAILED DESCRIPTION OF THE INVENTION

Figure 1:
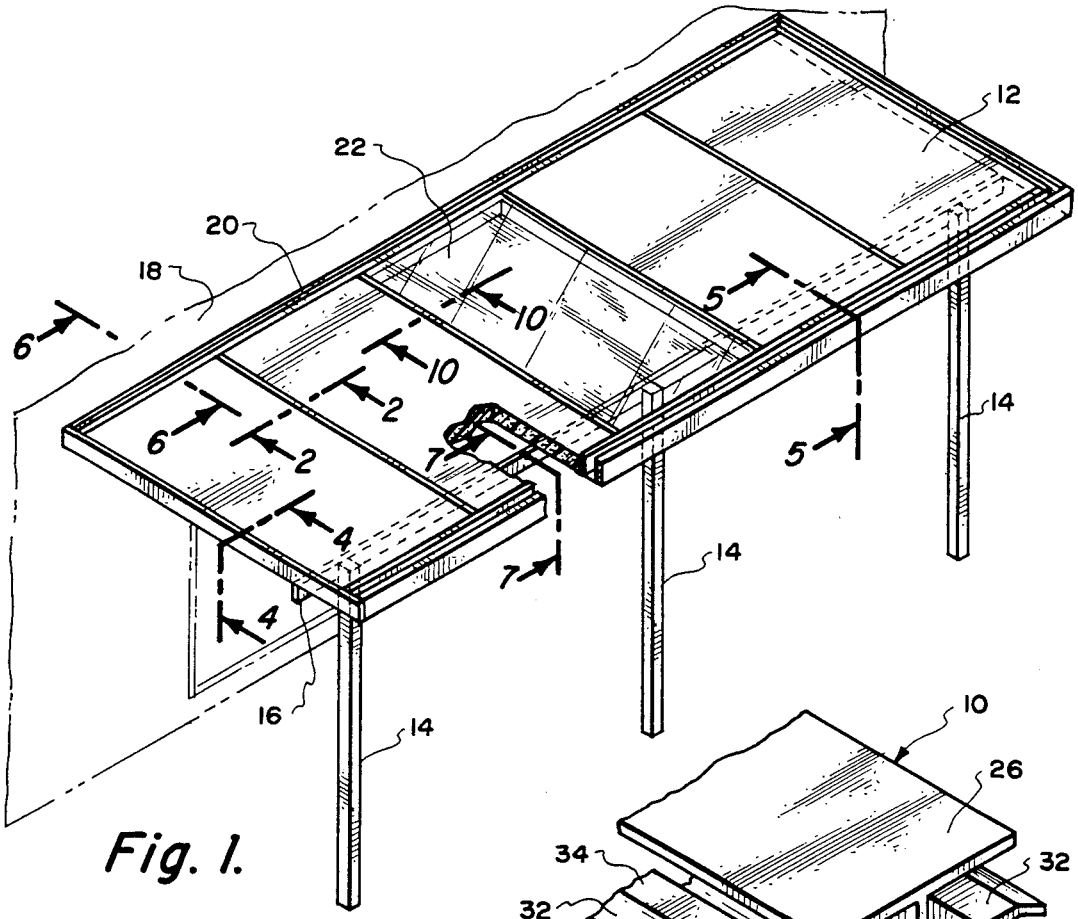
FIG. 1 is an isometric view of a roofing system constructed according to the invention.
Figure 3:
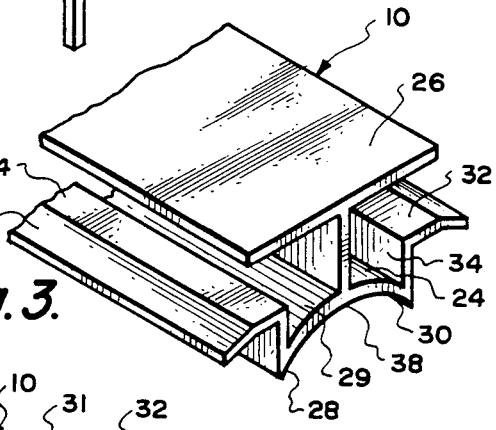
FIG. 3 is an isometric view partial section of the universal beam for coupling adjacent roofing panels.

The basis of the roofing system according to the invention is the use of a universal coupling beam (FIG. 8) for joining adjacent roof panels to form a patio or free standing roofing system. A roofing system employing the universal coupling beam is illustrated in FIG. 1 in which five panel sections 12 are joined by coupling beams to form a patio roof supported by three beams 14 attached to joist or cross-beam 16. The roofing system is joined to the wall 18 of building by waterproof flashing 20 ,which will be described in greater detail hereinafter. A unique feature of the coupling beam 10 is its ability to incorporate transparent synthetic panel 22 to form a skylight if desired, which will be described in greater detail hereinafter.

The universal beam 10 is similar in shape to an I-beam, having a center web 24 with a planar upper flange 26 and uniquely formed lower flanges 28 and 80 forming channels to facilitate water run-off. Wing-shaped, longitudinal flanges 82 on either side of flanges 28 and 80 provides an opening or slot between upper flange 26 and planar surface 34 for receiving foam roof panel flanges 36. Flanges 28 and 30 curve away from the center web 24 to provide a lengthwise concave channel 38 to assist in carrying away water channels 29 and 81 along either side of web 24.

Figure 2:
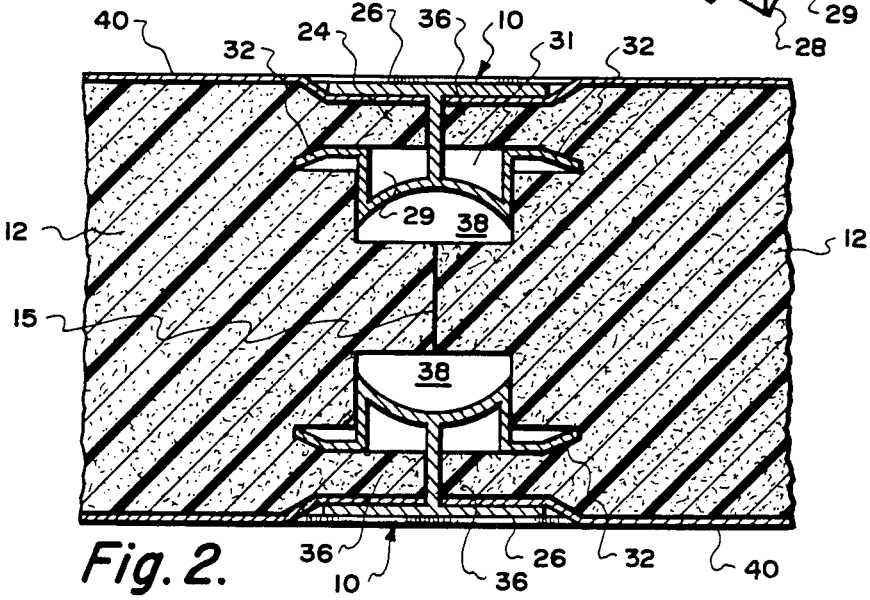
FIG. 2 is a sectional view taken at 2—2 of FIG. 1 illustrating the installation of universal coupling beams.

The universal beam is shown joining adjacent roof panels 12 in FIG. 2. The foam flanges or tongues 86 of adjacent roof panels are inserted between flanges 26 and 82 on universal beams 10 at the top and bottom and are held firmly in place by the slot formed by flanges 26 and 32. The lower beam 10 is reversed from the upper beam. The center portion of the roof panels 12 and 18 abut at 15 between universal coupling beams 10 at the top and bottom.

The unique structure and arrangement of beams 10 result in three channels to carry away excess water that might seep around the beam and sealing surfaces. Any water that might leak around flange 26 in upper beam, is carried away by channels 29 and 31 formed by the flanges attached to center web 24 of the universal beam 10. The lower beam on the underside of the roofing system is reversed providing third channel 88 to carry away any excess water that might overflow channels 29 and 31 should that occur.

Universal beam flanges 32 have an angled portion to facilitate assembly of the foam roof flanges 36 but also serve the additional purpose of providing two additional small channels to further disperse runoff of any excess water that might leak through the joints. Foam roof panels 12 are constructed with a reinforcing skin 40 at both the top and bottom which seals against the universal beams 10 and fastened by rivets, screws or any other suitable means (not shown). However, should any water leak around the flanges 26 and reinforcing skin 40, channels 28 and 31 will carry the water away from the building with channel 88 providing a back up channel to disperse any water overflowing the first two channels.

The system described presents an effective method of joining adjacent foam roof panels that substantially eliminate any leaking at the joints.

Figure 4:
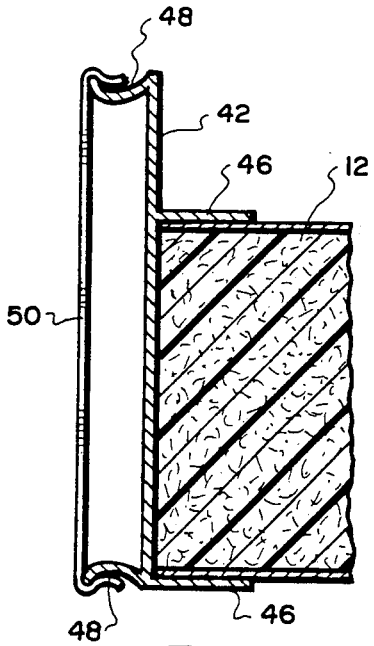
FIG. 4 is a sectional view taken at 4—4 of FIG. 1.
Figure 5:
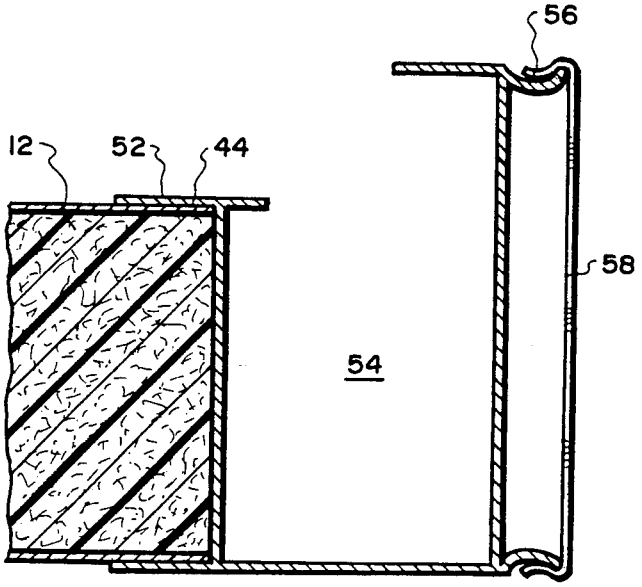
FIG. 5 is a sectional view taken at 5—5 of FIG. 1.
Figure 6:
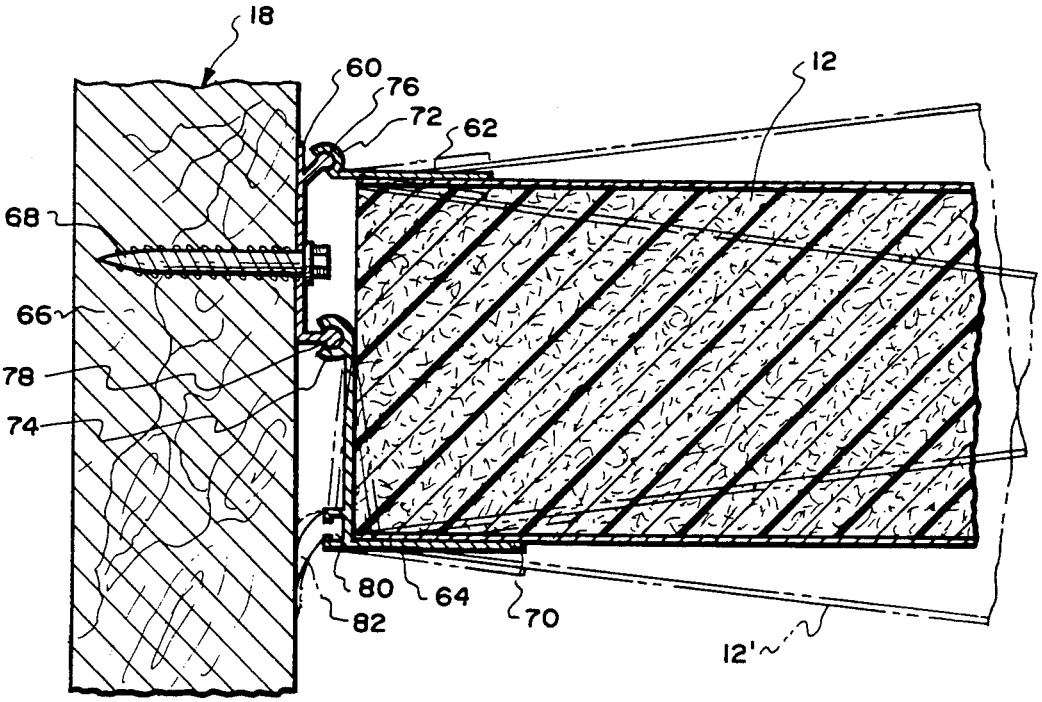
FIG. 6 is a sectional view taken at 6—6 of FIG. 1 illustrating a water-proof flashing system for mounting the roof.

The ends and front edges of the roofing system are capped with beams 42 and 44 shown in the sectional views of FIGS. 4 and 5. End cap 42 has flanges 46 that fit tightly against the foam roof panel 12 and provide additional curved flanges 48 for receiving decorative facing 50.

Cap 44 along the front edge of the roofing system 12 has flanges 52 tightly gripping the roofing panel 12 and is shaped to form a gutter at 54. The front surface is provided with flanges 56 also for attaching decorative facings 58.

A unique system is provided for attaching the assembled roof to a wall 18. The system is comprised of a ledger 60, upper mounting plate 62 and lower mounting L-shaped beam 64. Ledger 60 is secured to a wall header beam 66 with lag bolts 68 or any other suitable means. Roof panels 12 rest on angle or L-shaped beam 64 and are fastened by any suitable means such as rivets (not shown), to the bottom flange 70 and upper plate 62. The ledger 60, upper plate 62 and angle beam 64, are formed with pinless hinges 72 and 74 to allow flexibility for the roofing system. Ledger 60 has longitudinal ribbed flanges 76 and 78 at the top and bottom, respectively, which engage sockets 72 and 74 formed along longitudinal edges of upper plate 62 and angle beam 64. The ribs on the flanges 76 and 78, when engaged in the sockets, fully support the foam roofing system while allowing it to flex, as illustrated in phantom at 12'. Ledger 60 substantially seals and waterproofs the mounting system for the patio roof.

An additional seal is provided by a lengthwise channel 80 formed along a rear edge of angle beam 64. A resilient strip 82 is inserted in the channel and has a skirt 83 that flexibly presses against wall 18 providing an additional waterproofing seal.

Figure 7:
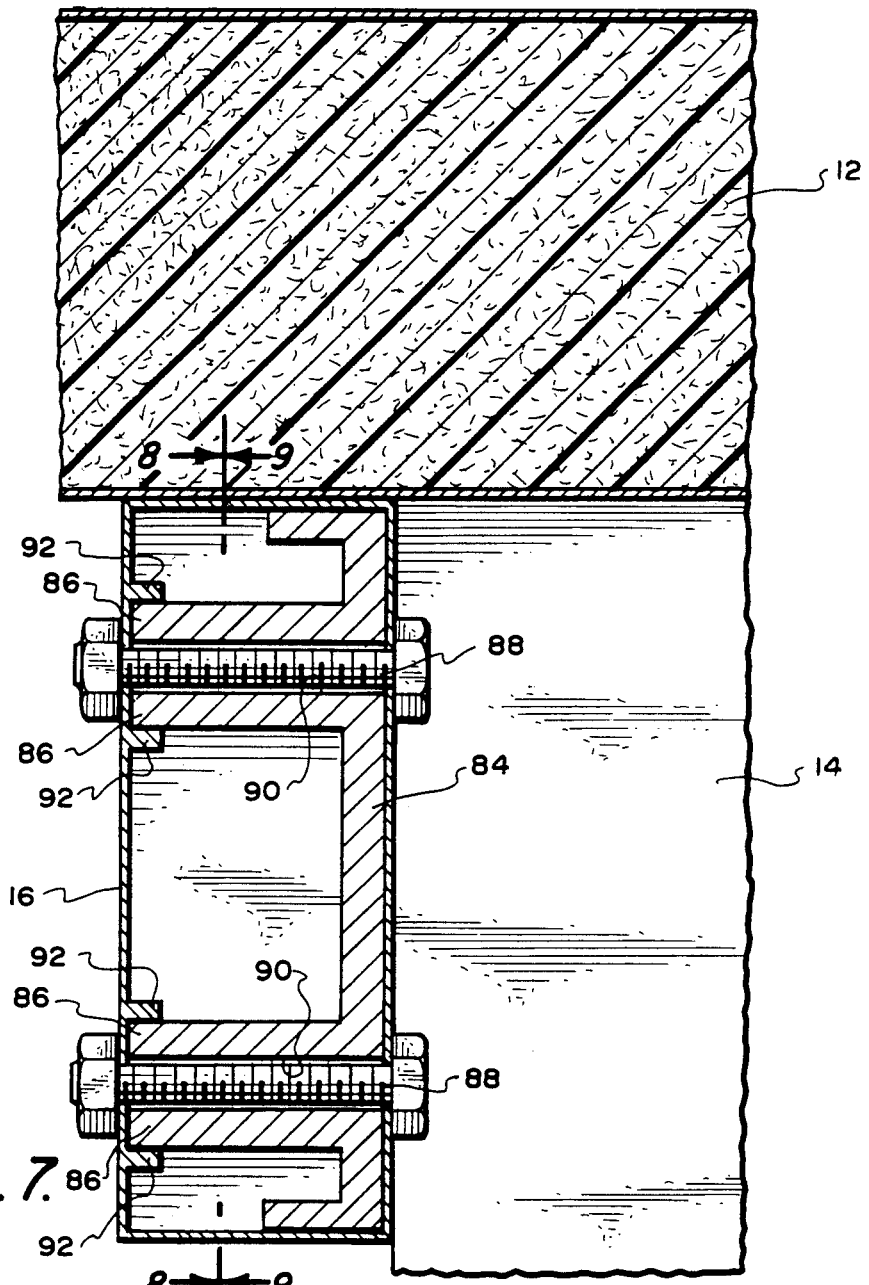
FIG. 7 is a sectional view taken at 7—7 of FIG. 1 illustrating a slicing system for joining adjacent hollow metal construction beams.
Figure 8:
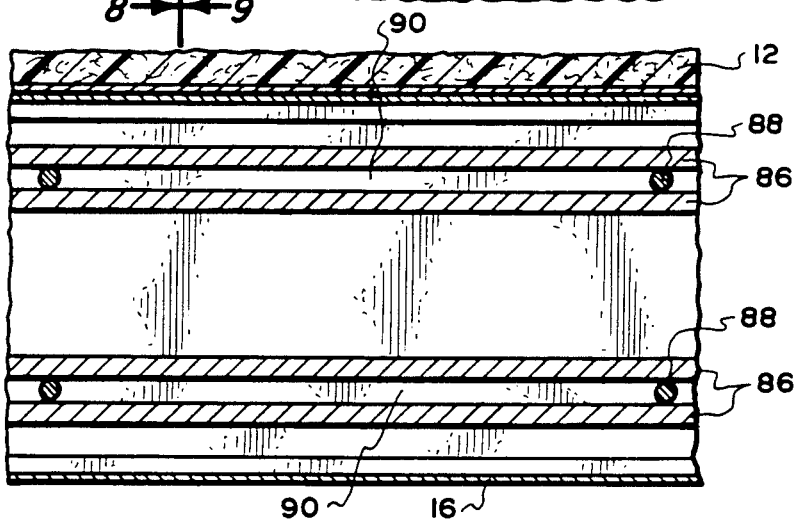
FIG. 8 is a sectional view taken at 8—8 of FIG. 7.
Figure 9:
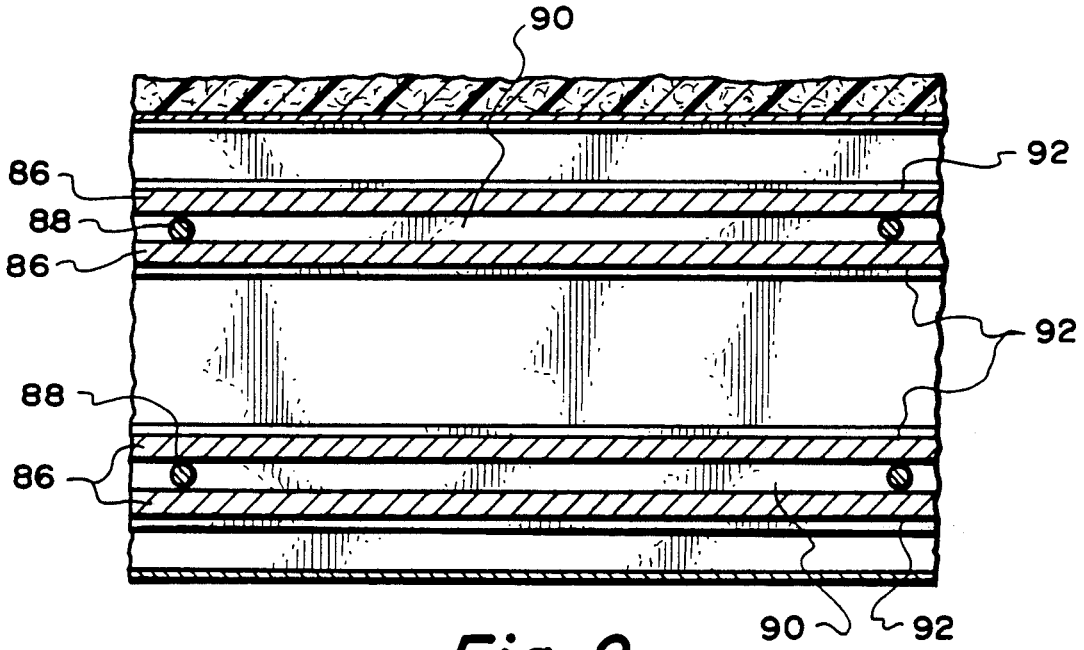
FIG. 9 is a sectional view taken at 9—9 of FIG. 7.

In some cases, the roofing system may have a length that exceeds the normal length of a single joist 16. In those cases, method is provided for joining adjacent joists. A system for splicing adjacent joists is illustrated in FIG. 7 through 9. Joist 16 is a hollow rectangular shaped metal construction that runs the length of the roofing system 12. A splicing insert B4 is constructed to fit the hollow interior of joist 16. Splice 84 is constructed of a durable steel or aluminum and has lengthwise stiffening ribs 86 forming a pair of lengthwise channels for receiving bolts 88. The stiffening ribs 86 have a length approximately equal to the interior width of joist 16. Thus, bolts 88 are passed through the joist or beams 16 and through lengthwise channels 90 to join the ends of adjacent beams. The stiffening ribs 86 prevent the joist from collapsing when bolts B8 are tightened down. With the reinforcing ribbed insert 84 installed only two bolts at either end are needed to provide a strong splice.

Preferably, guiding ridges 92 are formed on the interior surface of beams 16 to guide stiffening ribs 86 into the hollow interior. These ridges 82 prevent the splice insert 84 from binding when inserted in adjacent abutting ends of beams or joists 16.

To splice adjacent joists, splicing insert 84 is slid into the interior with strengthening ribs 86 being guided between ridges 92. The spliced coupling 84 extends six to twelve inches into each adjacent abutting joist 16. Bolts 88 are then passed through channels 90 through the beams and into channel 90 and tightened down to join adjacent joists. Stiffening ribs 86 prevent the joist from collapsing under the clamping force of the bolts 88.

Figure 10:
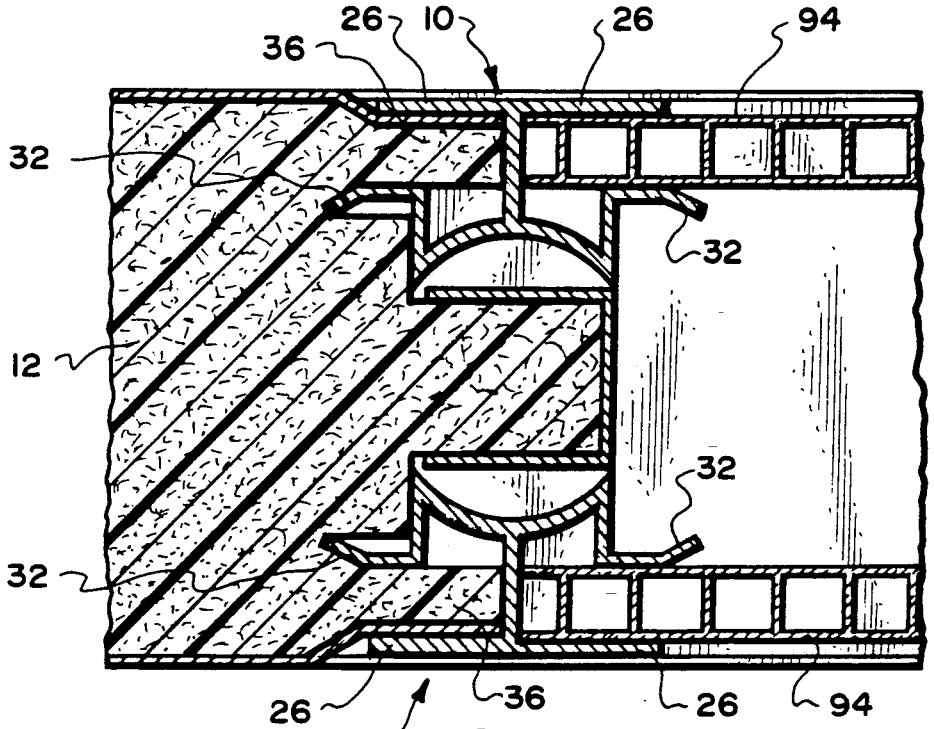
FIG. 10 is a sectional view taken at 10—10 of FIG. 1 illustrating the installation of a skylight in the roofing system using clear, synthetic panels.

An additional, but unique ability of the universal beam system 10 is to incorporate a skylight in the roofing system. This is shown in greater detail in FIG. 10. Roof panel flanges 86 are inserted in the slots formed by the flanges 26 and 32. The width of the slot formed by these flanges is constructed to accept a transparent synthetic panel 94 of Lexan or an equivalent material. Preferably, a separate transparent panel 94 is installed in both the upper and lower slots formed by flanges 26 and 82 in upper and lower beams 10. This arrangement provides an sealed enclosure between the top and bottom transparent panels which prevents condensation from forming in the skylight. This keeps the skylight clear and prevents clouding of the interior surfaces. The clear Lexan panels 94 engage similar slots in beams on the adjacent panel as shown in FIG. 1. Thus together, these panels form a skylight for a patio roof or any other roofing system desired.

Thus there has been disclosed a unique universal beam for joining foam roof panel that eliminates water leaks and provides a unique method of installing and coupling adjacent foam panels. The universal beam provides a cross-sectional shape that, when installed, can form five separate channels to carry away water. The flanges on the universal beam provide two channels on opposite sides of the web and a third channel on the outer surface opposite the first two channels. Wing-like appendages or flanges on the lengthwise on the beam provide additional small channels for carrying away excess water. When these beams are installed on upper and lower surfaces of foam roof panels, with the beams reversed from each other, they form two channels for carrying away excess water while the lower beam forms a third channel for catching and discharging any overflow. The wing-like appendages or flanges for mounting adjacent foam panels also form small channels for additional overflow, an unlikely event. The roofing system also includes a method of forming a skylight or transparent panel and a unique splicing system for joining joists to extend the length of the roofing system.

This invention is not to be limited by the embodiment shown in the drawings and described in the description which is given by way of example and not of limitation, but only in accordance with the scope of the appended claims.

What is claimed is:

1. A universal beam for joining upper and lower edges of foam roof panels comprising;

a generally I-shaped beam having a planar longitudinal flange along a first end of a center web and a pair of wing shaped flanges along the opposite end of said center web, said wing shaped flanges forming a pair of troughs substantially along the entire length of said beam between said center web and said flanges on one side and a concave channel on the other side; said planar longitudinal flange and said wing-shaped flanges being spaced apart to receive a tongue along an edge of a foam roof panel, said universal beam being reversible to join upper and lower edges of a foam roof panel; whereby a universal beam joining an upper edge of a foam roof panel will cooperate with a reversed universal beam joining a lower edge of a foam roof panel to provide a series of water dispersing channels.

2. The universal beam according to claim 1 in which said pair of wing-shaped flanges have their outer edges bent away from the planar longitudinal flange thereby facilitating insertion of a foam roof panel tongue and providing additional water dispersing channels.

3. A universal beam, according to claim 1, in which the space between said pair of longitudinal flanges and said planar longitudinal flange on said first end of said center web is selected to receive a transparent panel whereby a skylight may be incorporated into a roof structure.

4. A universal beam, according to claim 3, in which said pair of longitudinal flanges form wing-like appendages extending outward from said pair of flanges forming said channels to facilitate inserting of a structural member while also forming additional water dispersing channels.

5. A foam panel roof assembly comprising;

a plurality of foam roof panels having sides contoured to form tongues along the top and bottom edges of each side;

a generally T-shaped beam having a planar longitudinal flange along a first end of a center web and a pair of wing shaped flanges on the opposite end of said center web, said wing shaped flanges forming a pair of troughs along the length of said beam between said center web and said flanges on one side and a concave channel on the other side; said planar longitudinal flange and said wing-shaped flanges being spaced apart to receive a tongue along the edge of a foam roof panel;

said tongues on said foam roof panels constructed to fit said lengthwise slot in a respective universal beam;

said plurality of universal beams being a pair of said universal beams along the top and bottom edges of adjacent foam roof panels, the bottom beam being reversed from the top beam to form a series of water dispersing channels;

whereby said foam roof panels joined by respective reversed universal beams form a leak proof roof.

6. The roof assembly, according to claim 5, including means supporting said roof; said means comprising; one or more hollow joists attached to said roof; a plurality of beams attached to said joists; and means for splicing adjacent joist ends for extending said roof structure; said splicing means comprising an insert partially engaging adjacent ends of joists to be spliced; said insert including means for preventing said hollow joist from collapsing when joined with fasteners.

7. The roof assembly, according to claim 6, including means for attaching said roofing system to a wall; said wall attaching means comprising a ledger plate; means attaching said ledger plate to a wall surface; said ledge plate having a first part of a pinless hinge means forming means; plate means and angle means on said roof assembly forming a second part of a hinge forming means for engaging said hinge forming means on said ledge plate; whereby said roof structure is hingely supported on said wall.

8. The roof assembly, according to claim 7, in which said hinge formed on said roof assembly comprises a pair of ribbed flanges extending outward from said ledger plate and a flange forming a hinge socket extending outward from said plate means and said angle means respectively attached to said roof assembly; said ribbed flanges on said ledger plate engaging said sockets on said plate means and angle means respectively.

9. The roof assembly according to claim 8, including a resilient strip mounted on a lower edge of said roof assembly to provide a seal; said resilient seal being compressed against a wall when said roof is mounted.

10. The roof assembly, according to claim 9, in which said resilient seal is a flexible strip mounted in a c-shaped channel along a lower edge of said angle means supporting said roof assembly.

11. The roof assembly according to claim 6 in which said splicing means comprises a plate having a plurality of lengthwise stiffening ribs forming a pair of bolt channels; said stiffening ribs forming supports when inserted in said hollow beam preventing said beam from collapsing when adjacent joists are bolted together.

12. The roof assembly according to claim 11 in which said stiffening ribs are constructed to be equal to the inside width of said hollow joists.

13. The roof assembly according to claim 12 in which said joists are formed with a plurality of interior ridges for guiding said splicing means into said joists.

14. The roof assembly according to claim 5 including a pair of transparent panels between adjacent upper and lower reversed universal I-shaped beams forming a skylight.

15. The roof assembly according to claim 14 in which said transparent panel has a thickness approximately equal to the lengthwise slot formed along each side of said universal I-shaped beams; said transparent panel tightly engaging said lengthwise seats on each side along its length.

16. The roof assembly according to claim 14 in which said pair of transparent panels mutually engage the lengthwise slots in said universal I-shaped beams joining the upper and lower portions of said foam roof assembly; whereby a sealed enclosure is formed preventing condensation on the interior surfaces of said transparent panels.

17. The roof assembly according to claim 16 in which said transparent panels are constructed of a honeycomb shaped synthetic material.

* * * * *